United States Patent [19]

Schwartz

[11] 4,100,319

[45] Jul. 11, 1978

[54] STABILIZED NONWOVEN WEB

[75] Inventor: Robert J. Schwartz, Winneconne, Wis.

[73] Assignee: Kimberly-Clark Corporation, Neenah, Wis.

[21] Appl. No.: 791,832

[22] Filed: Apr. 28, 1977

Related U.S. Application Data

[63] Continuation of Ser. No. 595,701, Jul. 14, 1975, abandoned.

[51] Int. Cl.[2] ..... D04H 1/58

[52] U.S. Cl. ..... 428/171; 156/290; 156/306; 428/195; 428/288; 428/296

[58] Field of Search ..... 428/171, 195, 198, 288, 428/296; 156/209, 290, 306

[56] References Cited

U.S. PATENT DOCUMENTS

| | | | |
|---|---|---|---|
| 3,542,634 | 11/1970 | Such et al. | 428/135 |
| 3,748,216 | 7/1973 | Brock | 156/291 |

*Primary Examiner*—James J. Bell

*Attorney, Agent, or Firm*—Leydig, Voit, Osann, Mayer & Holt, Ltd.

[57] ABSTRACT

A process is described for the intermittent autogenous bonding of a continuous filament web wherein the filaments have a low degree of crystallinity. In one embodiment, the process involves passing the web directly through a nip formed by a smooth hard surfaced roll and a roll containing raised points on its surface with both rolls being maintained at a temperature near the softening point of the filaments. The speed of the web through the nip, the roll size and the configuration of the raised points are coordinated such that the surface temperature of the web is not substantially increased before maximum pressure has been developed in the nip, but then is rapidly raised to a point where surface fusion is effected before a significant increase in filament crystallinity occurs. Webs prepared as illustrated possess a desirable combination of surface abrasion resistance and strength.

3 Claims, No Drawings

STABILIZED NONWOVEN WEB

This is a continuation, of application Ser. No. 595,701, filed July 14, 1975 now abandoned.

The present invention relates to stabilizing nonwoven webs into coherent structures. More particularly, it concerns webs of molecularly oriented, thermoplastic fibers autogenously bonded to provide fabric-like materials possessing a desirable combination of physical and aesthetic characteristics. The invention is especially concerned with the stabilization of nonwoven fiber webs of substantially continuous thermoplastic filaments.

Nonwoven webs comprising a plurality of substantially continuous and randomly deposited, molecularly oriented filaments of a thermoplastic polymer are now widely known. The following patents illustrate a variety of methods for preparing such webs and for bonding them into coherent structures: Kinney (U.S. Pat. Nos. 3,338,992 and 3,341,394), Levy (U.S. Pat. No. 3,276,944), Petersen (U.S. Pat. No. 3,502,538), Hartmann (U.S. Pat. Nos. 3,502,763 and 3,509,009), Dobo et al. (U.S. Pat. No. 3,542,615), Dorschner et al. (U.S. Pat. No. 3,692,618), Vosburgh (U.S. Pat. Nos. 3,459,627 and 3,368,934), Harmon (Canadian Pat. No. 803,714, and Cumbers (British Pat. No. 1,245,088).

What has heretofore been considered to be a particularly desirable method of obtaining bonded nonwoven continuous filament webs, particularly at low basis weights, is described in U.S. Pat. No. 3,855,046, issued on Apr. 15, 1971. As illustrated in this patent, the nonwoven web is initially prepared by the method described in the above-identified U.S. Pat. No. 3,692,618 and thereafter autogenously bonded in an intermittent fashion.

The method of initial web formation involves extruding a thermoplastic polymer through a multiple number of downwardly directed spinning nozzles, preferably extending in a row or a multiple number of rows. The filaments, as they are spun, are then gathered into a straight row of side-by-side, evenly spaced apart, untwisted bundles, each containing at least about fifteen and preferably from fifty up to one thousand filaments. These filament bundles are simultaneously drawn downwardly at a velocity of at least three thousand meters per minute, and preferably from 3,500 to 8,000 meters per minute in individually surrounding gas columns flowing at supersonic velocity and directed to impinge on a substantially horizontal carrier. The gathering of the filaments into the untwisted bundles and their drawing and directing to impinge on the carrier is preferably effected by passing the bundles to air guns which surround the filaments with a column or jet of air which is directed downwardly at supersonic velocity. The air guns are arranged so as to extend in one or more rows extending across the carrier at right angles to its direction of movement, so that the bundles confined in the gas columns as the same strike the moving carrier extend in a line or row at right angles across the carrier.

In accordance with the aforementioned U.S. Pat. No. 3,855,046, after formation of the nowoven web on the carrier, web bonding is then effected by passing the web from the carrier into contact with a smooth surfaced heated roll and, after a given degree of prewrap and accompanying preheating on the roll, passing the web between a high pressure nip formed by the smooth surface roll and a second heated roll containing raised points on its surface. The web so prepared contains intermittent compressed regions of autogenous filament bonds, is soft and drapable, possesses a desirable tensile strength and capacity to absorb energy under strain and, with respect to the webs illustrated therein, desirable surface abrasion resistance.

While the manner of web bonding illustrated in U.S. Pat. No. 3,855,046 is quite suitable for preparing materials having basis weights up to about 1 oz./yd.$^2$ or so, as interest developed in higher basis weight materials, it was noted that it became more difficult to achieve optimum surface abrasion resistance on both sides of the web while maintaining the other desirable characteristics. In particular, the problem was in obtaining abrasion resistance on the side of the web which was prewrapped around the smooth surfaced roll prior to passage through the nip. And, while abrasion resistance of this surface could be increased through the use of more intense bonding conditions (e.g. by increasing the nip pressure and temperature of the heated rolls), this was accompanied at the sacrifice of optimum tensile strength, energy absorption and drape.

The present invention is particularly addressed to an improvement in the bonding process disclosed in the aforementioned U.S. Pat. No. 3,855,046 whereby, with respect to higher basis weight webs, the combination of desirable two-sided surface abrasion resistance and physical strength properties can be achieved. However, as will be apparent, the technique described herein is broadly applicable to the preparation of nonwoven webs of molecularly oriented thermoplastic filaments which have a particular combination of crystallization dependent bonding characteristics.

For the purposes of the present invention, the following definitions are applicable: "Continuous filament web" is a nonwoven web of substantially continuous and randomly arranged, molecularly oriented filaments of a crystallizable thermoplastic polymer wherein substantially all of the filaments have about the same softening point. "Intermittent autogenous bonding" is a process wherein bonding is accomplished simply by applying heat to a substantially unbonded web at intermittent areas which define the upper and lower surfaces of intermittent regions of the web which are compressed under a pressure of at least about 2000 psi. "Stabilized web" is a continuous filament web bonded by intermittent autogenous bonding which is characterized by having a surface abrasion resistance (on both sides) of at least about 20 (determined as hereinafter described) and a basis weight normalized grab tensile strength (average of MD and CD) of at least about 20 lbs./(oz./yd.$^2$) (also determined as hereinafter described).

Briefly stated, the present invention is based on the discovery that, with respect to high basis weight webs prepared in a manner such as illustrated in U.S. Pat. No. 3,692,618, eliminating thermal pretreatment prior to bonding is necessary in order to fashion a stabilized web. In its broadest aspect, the present invention is believed to reside in the discovery that the preparation of stabilized webs by intermittent autogenous bonding is dependent to a significant extent on not permitting the crystallinity of the web filaments to exceed a certain low level prior to the bonding process.

As will hereinafter become apparent, the present invention is especially applicable to the preparation of stabilized continuous filament webs having a basis weight of at least about 1 oz./yd.$^2$ of polypropylene filaments having a crystallinity of less than about 45% which exhibit a very rapid rate of crystallization over an intermediate temperature range which is above ambient temperature and substantially below the filament softening temperature. With respect to such webs and in accordance with the present invention, stabilization is accomplished by intermittently autogenously bonding the web such that the areas thereof defining the surfaces of the compressed regions are substantially instantaneously raised to a temperature near the filament softening point before filament crystallinity is increased to a significant degree.

In more detail and in accordance with one embodiment, the process described herein involves intermittent autogenous bonding of a continuous filament web wherein the filaments have a low degree of crystallinity by passing the web at about ambient temperature directly through a nip formed by a smooth surfaced roll and a roll containing raised points on its surface with both rolls maintained at a temperature near the softening point of the filaments. The speed of the web through the nip, the roll size and the configuration of the raised points are coordinated such that the surface temperature of the web is not substantially increased before maximum pressure has been developed in the nip, but then is rapidly raised to a point where surface fusion is effected before a significant increase in filament crystallinity occurs. Due to the thermal gradient across the web, there is no substantial filament fusion within the interior thereof.

In fully appreciating the present invention, it is believed necessary to first understand the nature of filament bonding present in a stabilized web prepared by intermittent autogenous bonding. The filaments on the web surfaces are fused together over the intermittent bond areas with the areas having a film-like appearance. Thus, under the action of an abrading force the filaments are unable to pull free in a continuous manner though localized filament breakage, such as at where a filament enters a bond area, may occur. The principal aspect, however, is that abrasion does not result in the creation of continuous filament spans on the web surfaces which would present an undesirable, fuzzy, pile-like appearance.

While filament fusion is desirable on the web surfaces for abrasion resistance, directly the opposite is so within the interior of the web insofar as obtaining desirable strength and energy absorption. As explained in U.S. Pat. No. 3,855,046, these latter characteristics are present when bonds between filaments have a strength such that, as strain is progressively applied to the web, filaments release from each other when the strain approaches the filament breaking strength. Such bonds have been termed "release" bonds and are characterized by an absence of substantial fusion between filaments — the nature of the bond being more of mechanical or cohesive attachment due to filament deformation and the increase in effective contact area between filaments which accompanies compression of the web in the bonding nip.

Therefore, it is believed that a stabilized continuous filament web is characterized as having fused autogenously bonded filaments within intermittent areas on the web surfaces with releasably autogenously bonded filaments within the interior of the web between the fused surface areas. And, with respect to high basis weight continuous filament webs prepared such as described in U.S. Pat. No. 3,692,618, obtaining this combination of filament bonds by the procedure described in U.S. Pat. No. 3,855,046 was quite difficult. The principal problem, as now understood, apparently residing in the fact that preheating of the web raised filament crystallinity and, in turn, softening temperature thus necessitating very intense bonding conditions to achieve surface filament fusion or two-sided abrasion resistance. As a result, over-bonding and accompanying excessive fusion was created within the interior of the web which adversely affected the web's strength characteristics.

In contrast, by eliminating preheating in accordance with the present invention, low crystallinity can be maintained and surface filament fusion effected under thermal conditions which do not lead to detrimental fusion within the web interior. Two reasons, and probably a combination of both, are believed to be responsible for the absence of such interior fusion. The first reason is simply that less intense bonding conditions, both with respect to pressure and temperature, are needed to achieve necessary surface fusion. Therefore, due to the thermal gradient from the web surfaces to the center, there is less likelihood of fusion in the web interior. Secondly, due to the thermal gradient, crystallinity of the interior filaments and particularly those close to the web surfaces increases before an appropriate softening temperature is reached, thus diminishing the possibility of fusion.

Why preheating as illustrated in U.S. Pat. No. 3,855,046 adversely affects web stabilization is not known for sure. However, as has been indicated, it is believed to be related to an increase in filament crystallinity. And, in this respect, it should be noted that the filaments contained in webs prepared such as illustrated in the U.S. Pat. No. 3,855,046 believed to have several distinctive crystallinity characteristics. These characteristics are a low degree of crystallinity as prepared, a very rapid rate of crystallization on exposure to a moderate elevated temperature, and a stiffness at a temperature near the softening point which increases as the degree of crystallinity increases. The advantages in obtaining a stabilized web by means of the present process are believed to be especially applicable with respect to webs having these crystallinity characteristics.

Turning to the aspect of using webs containing filaments with a low degree of crystallinity, this, as has been mentioned, is believed to be important since, so long as such low crystallinity can be maintained during bonding, the possibility of effecting filament fusion at a lower temperature exists (see e.g. the above-identified Levy patent). The degree of crystallinity can be determined by well-known X-ray diffraction techniques such as described by Weidinger and Hermans, Makromol Chem. 50 98 (1961). For the purpose of the present invention, the term low crystallinity refers to a level of crystallinity below the equilibrium value and generally at least about 5% below the equilibrium value. The equilibrium value is the level of crystallinity present after annealing for an extended periof of time a temperature near but below the melting point. Particularly useful polypropylene filaments are those wherein crystallinity is about 45% or less (55% or higher being the equilibrium value.) As is well known in the art, the crystallinity present in a filament depends to a significant extent on the thermal history which the filament experiences after spinning and drawing. Filaments with low crystallinity can be prepared by rapid quenching to room temperature or below after pneumatic, melt drawing or by unheated mechanical drawing of quenched solidified filaments.

As indicated, a second characteristic of filaments contained in webs which can be advantageously stabilized by the present process is a rapid rate of crystallization. The fact that the rate of crystallization of thermoplastic filaments is temperature dependent — being slow at both ambient temperatures and at temperatures approaching the melting point and reaching a maximum at an intermediate temperature between these two — is recognized. However, in contrast to many crystallizable filaments, the process of the present invention is especially applicable to webs fashioned with filaments having an extraordinarily rapid rate of crystallization, such that, even with a short pre-heat, the degree of crystallinity is significantly increased.

Melt drawn filaments as illustrated in U.S. Pat. No, 3,692,618 wherein high shear is present during drawing followed by a rapid quench to room temperature, are believed to typify filaments having an especially high rate of crystallization. It has been noted that the differential thermal analysis (DTA) curve of a filament sample prepared in such a manner exhibits a significant thermal response at a temperature below that attributable to crystallite melting. It is believed that filaments having such DTA curves will possess an extraordinarily rapid rate of crystallization.

The last characteristic of filaments contained in webs especially suitable for stabilization by the present process is that their stiffness increases with filament crystallinity. As has been indicated, web strength is believed to depend on "releasable" filament bonds which are fashioned in part by attachment due to filament deformation. In turn, under a given pressure release bonding should be enhanced with filaments having a lower stiffness. Therefore, if deformation is effected before an increase in crystallinity occurs, enhanced strength should be obtainable. With respect to a polypropylene, at least a doubling in stiffness at a temperature of about 140° C. accompanying a crystallinity change of about 45% to 60% is believed to be indicative of this type of characteristic.

Table 1 describes useful parameters for preparing continuous filament webs which are especially applicable for stabilization in accordance with the present invention. The web forming apparatus and procedure illustrated in U.S. Pat. No. 3,692,618 wherein spun filaments are melt drawn using supersonic air guns are applicable.

TABLE 1

| | In General |
|---|---|
| Polypropylene Polymer (Isotactic) | |
| Wt. Ave. M.W. / No. Ave. M.W. | Less than 5 |
| Melt Index of Polymer at Extruder Outlet (measured at 190° C. - 2160 grms.) | Greater than 18 |
| Flow Rate at Spinneret Outlet | 1.6 m/min. |
| Filament Rate at Air Gun Inlet | 4000 m/min. |
| Conditions | |
| Quench Air | 75° F. - 85% RH |
| Filament Draw Down (from Spinneret to Final Filament) | |
| In cross-sectional area | From 2500 to 1 |
| In diameter | From 850 micron to 17 micron |

In order to illustrate the present invention, a web (1.5 oz./yd.$^2$); filaments having a denier of about 2.0 tenacity of about 2.8 g.p.d.; elongation of about 150%, and crystalline melting point of about 165° C.) prepared under the above conditions was stabilized by passing it at a speed of 32 ft./min. directly through a nip formed by two heated steel rolls under the following conditions:

| | Temperature | Diameter | Surface | Pressured on Raised Points |
|---|---|---|---|---|
| Roll 1 | 145° C. | 7" | Smooth | — |
| Roll 2 (driven) | 145° C. | 7" | Raised Points * | $3.5 \times 10^3$lbs./in.$^2$ ** |

* each point diamond shaped with each side 0.0285 inch, 0.04 in. high, 200 points/in.$^2$, arranged in a diamond pattern with diagonal of pattern and points in machine direction through nip.

** effective nip area determined by direct measurement from imprint on impression paper obtained while rolls are loaded under operating pressure but not rotating.

Thereafter, the abrasion resistance and the grab tensile strength of the stabilized web were measured as follows:

Abrasion measurements were made using the standard Taber abrasion method. The results are obtained in abrasion cycles to failure. For purposes of the present invention, failure is deemed to occur at that point where a noticeable portion of the web surface subjected to abrasion in the test exhibits a fuzzy, pile-like appearance primarily due to web filaments being pulled out of compacted areas although some filament breakage may also occur. As so determined, the failure point occurs prior to filament piling on the web surface. FIG. 19 in copending Hansen et al. application, Serial No. 177,077 now U.S. Pat. No. 3,855,046, illustrates the surface appearance of a typical web at failure. Measurements are made using a Taber Standard Abrader (Model 140 PT) with a rubber calibrase #S-32 wheel on the right abrading head and a 125 gram counterweight (total load of 125 grams).

Grab tensile strength (lbs./in.) was determined using a conventional Instron tensile testing machine in accordance with ASTM D-1117, part 5, p. 216, part 24.

The abrasion resistance and tensile strength of the web prepared as above described (Sample Web A) are given in Table 2.

TABLE 2

| | Abrasion Resistance | | Tensile Strength | |
|---|---|---|---|---|
| | Side in Contact with Roll 1 | Side in Contact with Roll 2 | MD | CD |
| Sample Web A | 80+ | 80+ | 34.8 | 30.1 |

In order to illustrate the effect of a heat pretreatment on the above characteristics other webs were passed through the above-identified nip after having experienced various degrees of preheating. Preheating was accomplished by contacting a surface of the web with a heated smooth surfaced roll at about 145°–147° C. over the following time intervals: 0.09 sec.; 0.11 sec.; 0.15 sec.; and 0.4 sec. Abrasion resistance and grab tensile measurements are given in Table 3 for webs wherein the preheated side of the web was in contact with the roll with raised points (Roll 2) in the bonding nip.

TABLE 3

| | | ABRASION RESISTANCE | | TENSILE STRENGTH | |
|---|---|---|---|---|---|
| Web | Preheat (Sec.) | Side in Contact with Roll 1 | Side in Contact with Roll 2 | MD | CD |
| B | 0.09 | 80+ | 33 | — | 30.2 |
| C | 0.11 | 50 | 29 | 35.7 | 26.8 |

TABLE 3-continued

| Web | Preheat (Sec.) | ABRASION RESISTANCE Side in Contact with Roll 1 | Side in Contact with Roll 2 | TENSILE STRENGTH MD | CD |
|---|---|---|---|---|---|
| D | 0.15 | 50 | 20 | 33.8 | 26.2 |
| E | 0.4 | 50 | 18 | 26.9 | 25.— |

Table 3 illustrates that both abrasion resistance and strength diminish with increasing preheating. And, for the purpose of correlating this behavior with filament crystallinity, the percent crystallinity of filaments in Webs A, B and E was determined by X-ray analysis after the indicated preheating for Webs B and E and after bonding for Web A. As prepared, the filaments in all of these webs had a crystallinity of about 40%. The values of crystallinity so obtained are given in Table 4.

TABLE 4

| WEB | CRYSTALLINITY AFTER BONDING | AFTER PREHEAT |
|---|---|---|
| A | About 55% | — |
| B | — | About 45% |
| E | — | About 65% |

Similarly for the purpose of illustration, the effect of percent crystallinity on stiffness was determined for polypropylene using compression molded samples. Specimens were die-cut (ASTM D-638 type IV, dumb-bell shape) and the stiffness moduli (100× force required for 1% extension) was determined using an Instron at a strain rate of 0.2 in./min. At about 140° C., samples with about 45% and 60% crystallinity exhibited a moduli of about 100 lbs./in.$^2$ and about 250 lbs./in.$^2$, respectively.

Referring to Tables 2 and 3, it will be seen that webs A-D, wherein preheating was for less than about 0.15 seconds, exhibit a desirable combination of abrasion resistance and tensile strength. In particular, the abrasion resistance on both sides of the webs is at least about 20 and the basis weight normallized tensile strength (the average of the MD and CD values divided by the web basis weight of 1.5 oz./yd.$^2$) is at least about 20 lbs./(oz./yd.$^2$). Furthermore, as can be seen from Table 2, the elimination of any preheating results in a dramatic increase in abrasion resistance and, accordingly, webs can be prepared in accordance with the preferred aspects of the present invention having an abrasion resistance of at least about 50 and a basis weight normallized tensile strength of at least about 20.

Also, while not illustrated in the foregoing tables, the webs prepared in the manner described above possess desirable textile-like qualities with respect to drape and hand. On visual examination, the webs are seen to have intermittent compressed regions extending through their thickness corresponding to the raised points on the roll 2. Webs A-D do not have a glazed surface and, particularly with respect to web A, on being held up to a light source there is a marked contrast between the bond areas and the regions disposed therebetween with the bond areas being noticeably more shiny and film-like.

In addition to the above-discussed attributes, webs prepared in accordance with the illustrated technique and having a basis weight of about 1 oz./yd.$^2$ – 3 oz./yd.$^2$, and, particularly 1.25 oz./yd.$^2$, – 2.5 oz./yd.$^2$, have good delamination resistance and tear strength. While it is believed that the latter of these properties is achieved through the same mechanism which contributes to the desirable tensile strength characteristics, the level of delamination resistance achieved is considered to be an unexpected benefit.

Since in the absence of preheating it would be expected that the center portion of the web would experience only a very slight increase in temperature on passage through the bonding nip, very little physical attachment between filaments in this region would be anticipated and, in turn, it would be expected that the web could be peeled apart. However, in fact, such cannot be easily accomplished thus permitting the elimination of preheating with the accompanying benefits discussed above without a substantial loss in delamination resistance. While as higher basis weight webs than those illustrated are employed, delamination resistance will probably diminish, it is believed that such can be minimized by instantaneously raising the temperature of the web while it is in the bonding nip. One suggested manner of doing this is in the direct introduction of a thin jet of steam into the web coincident with its introduction into the nip.

As mentioned above, webs prepared in accordance with the present invention possess a desirable textile-like drape and hand. These attributes are believed to be principally due to the fact that intermittent bonding is employed to effect web stabilization. And, in this respect, it is believed that webs having discrete bond areas occupying about 5–50% of the web surface area and disposed in a density of about 50 – 3200 areas/in.$^2$ are useful. As should be appreciated, in achieving textile-like qualities the use of higher bond densities and total bond area is associated with the use of lower basis weight webs with finer filament deniers. And, as basis weight and filament denier increase, the density of the bond areas should be correspondingly reduced. With respect to webs having a basis weight of about 1.25 – 2.5 oz./yd.$^2$ containing filaments having a denier of about 0.5 – 10, and particularly 1–5, a total bonded area of about 10–25% and a bond density of about 100–50-0/in.$^2$ are preferred.

As a further point, it will be recalled that the desirable strength characteristics achieved by the presently illustrated process are believed to reside in achieving filament deformation in the high pressure nip which contributes to the discussed "release" bonding. It is believed that the extent of deformation and in turn the degree of "release" bonding is dependent on the shear which the web experiences as it passes through the bonding nip.

With respect to the illustrated process, a high degree of shear is believed to be present. Both of the rolls employed for bonding are hard surfaced, thus insuring filament deformation in the nip rather than mere conformity with the roll pattern. Also, the fact that the rolls have a small radius of curvature is believed to increase shear accompanying passage through the nip. And in this respect it is believed that as roll diameter increases, correspondingly higher nip pressures should be used. Thus, while as is illustrated in Table 1 with about 7 inch diameter rolls a nip pressure on raised points of about 3500 psi. is adequate, a higher nip pressure, for example, about 5000 psi., would be more appropriate for larger rolls such as those having a 16 inch diameter. Similarly, with higher basis weight webs greater nip pressures are necessary to achieve adequate bonding. In general, nip pressures in excess of 50,000 psi. should be avoided so as not to overly deform the filaments to a point where they are materially weakened. However, as a practical matter, bonding in accordance with the present invention will generally require the use of pressures in excess of about 1500 psi. With the above in mind, it should also be apparent that other means for increasing shear can also be used such as employing rolls with matching or slightly offset raised points or by using variably driven rolls.

While the invention has been described in connection with certain preferred embodiments, it is to be understood that the invention is not to be limited to those embodiments. On the contrary, all alternatives, modifications, and equivalents as can be included within the scope and spirit of the invention defined in the appended claims are intended to be covered.

I claim as my invention:

1. A nonwoven continuous filament web of polypropylene filaments having a basis weight of about 1–3 oz./yd.$^2$, a surface abrasion resistance on both sides thereof of at least about 20, and basis weight normalized grab tensile strength of at least about 20 lbs./(ox./yd.$^2$), said web being further characterized by the presence of intermittent compressed autogenous bond regions of a size and density to provide textile-like qualities which extend through the thickness of the web with the filaments on both outer surfaces of the bond regions being substantially fused to give a film-like appearance and with the filaments within the interior of the web between both said outer fused surfaces of the bond regions being deformed without substantial fusion to provide delamination resistance.

2. The web of claim 1 having a basis weight of about 1.25 – 2.5 oz./yd.$^2$ wherein the compressed bond regions are present in a density of about 100 – 500/in.$^2$ and occupy about 10–25% of the web surface area.

3. The web of claim 1 wherein the surface abrasion resistance on both sides thereof is at least about 50.

* * * * *